US009975726B2

(12) United States Patent
Yanagawa

(10) Patent No.: US 9,975,726 B2
(45) Date of Patent: May 22, 2018

(54) POST-PROCESSING APPARATUS AND IMAGE FORMING SYSTEM

(71) Applicant: FUJI XEROX CO., LTD., Tokyo (JP)

(72) Inventor: Teisuke Yanagawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days. days.

(21) Appl. No.: 15/684,243

(22) Filed: Aug. 23, 2017

(65) Prior Publication Data

US 2018/0111786 A1 Apr. 26, 2018

(30) Foreign Application Priority Data

Oct. 24, 2016 (JP) ..... 2016-207460

(51) Int. Cl.

| | |
|---|---|
| ***B65H 45/30*** | (2006.01) |
| ***B65H 37/04*** | (2006.01) |
| ***B65H 37/06*** | (2006.01) |
| ***B31F 1/08*** | (2006.01) |
| ***B31F 1/10*** | (2006.01) |

(52) U.S. Cl.

CPC ..... *B65H 45/30* (2013.01); *B31F 1/08* (2013.01); *B31F 1/10* (2013.01); *B65H 37/04* (2013.01); *B65H 37/06* (2013.01); *B65H 2301/43828* (2013.01); *B65H 2801/27* (2013.01)

(58) Field of Classification Search

CPC ... B31F 1/08; B31F 1/10; B65H 37/04; B65H 37/06; B65H 45/30; B65H 2301/43828; B65H 2801/27

USPC ..... 270/37, 58.07; 493/59, 60, 240, 241, 493/355, 396, 397

See application file for complete search history.

(56) References Cited

U.S. PATENT DOCUMENTS

| | | | | |
|---|---|---|---|---|
| 6,823,571 | B1 * | 11/2004 | Ragland | B21D 11/07 270/39.01 |
| 7,024,736 | B2 * | 4/2006 | Ragland | B21D 11/07 270/39.01 |
| 8,974,360 | B2 * | 3/2015 | Musha | B31F 1/10 270/58.07 |
| 2006/0229184 | A1 * | 10/2006 | Powell | B31F 1/10 493/467 |

(Continued)

FOREIGN PATENT DOCUMENTS

| | | |
|---|---|---|
| JP | 2012-66436 A | 4/2012 |
| JP | 2015-9971 A | 1/2015 |

*Primary Examiner* — Leslie A Nicholson, III
(74) *Attorney, Agent, or Firm* — Oliff PLC

(57) ABSTRACT

A post-processing device includes first and second opposite members extending in a predetermined direction of a recording medium, the opposite members each including a first surface having a protrusion and a second surface having a recess, mutually facing to interpose the recording medium therebetween and being rotatable. A position of the opposite members is switched between a first position, at which the first surface of the first opposite member and the second surface of the second opposite member engage with each other and form a crease protruding in a first direction on the recording medium, and a second position, at which the second surface of the first opposite member and the first surface of the second opposite member engage with each other and form a crease protruding in a second direction reverse to the first direction on the recording medium, depending on an output destination of the recording medium.

5 Claims, 7 Drawing Sheets

(56) References Cited

U.S. PATENT DOCUMENTS

| | | | | |
|---|---|---|---|---|
| 2012/0308334 | A1* | 12/2012 | Nonoshita | B42C 7/005<br>412/11 |
| 2014/0357463 | A1* | 12/2014 | Kojima | B65H 45/30<br>493/442 |
| 2015/0000488 | A1* | 1/2015 | Yanagawa | B65H 35/02<br>83/73 |

* cited by examiner

POST-PROCESSING APPARATUS AND IMAGE FORMING SYSTEM

CROSS-REFERENCE TO RELATED APPLICATIONS

This application is based on and claims priority under 35 USC 119 from Japanese Patent Application No. 2016-207460 filed Oct. 24, 2016.

BACKGROUND

Technical Field

The present invention relates to a post-processing apparatus and an image forming system.

SUMMARY

According to an aspect of the invention, there is provided a post-processing device, including a pair of first and second opposite members extending in a predetermined direction of a recording medium, each of the opposite members including a first surface having a protrusion and a second surface having a recess, the opposite members facing each other to interpose the recording medium therebetween and being rotatable. A position of the opposite members is switched between a first position, at which the first surface of the first opposite member and the second surface of the second opposite member engage with each other and form a crease protruding in a first direction on the recording medium, and a second position, at which the second surface of the first opposite member and the first surface of the second opposite member engage with each other and form a crease protruding in a second direction reverse to the first direction on the recording medium, depending on an output destination of the recording medium.

BRIEF DESCRIPTION OF THE DRAWINGS

An exemplary embodiment of the present invention will be described in detail based on the following figures, wherein.

DETAILED DESCRIPTION

The present invention is described in detail below according to an exemplary embodiment and specific examples with reference to the drawings. However, the present invention is not limited to the exemplary embodiment and specific examples.

Also, in the description with reference to the drawings, it is to be noted that the drawings are schematic drawings and the ratio of respective dimensions etc. is different from the actual value. For easier understanding of the drawings, illustration of members other than the members required for explanation is omitted as appropriate.

(1) General Configuration and Operation of Image Forming System

Figure 1:
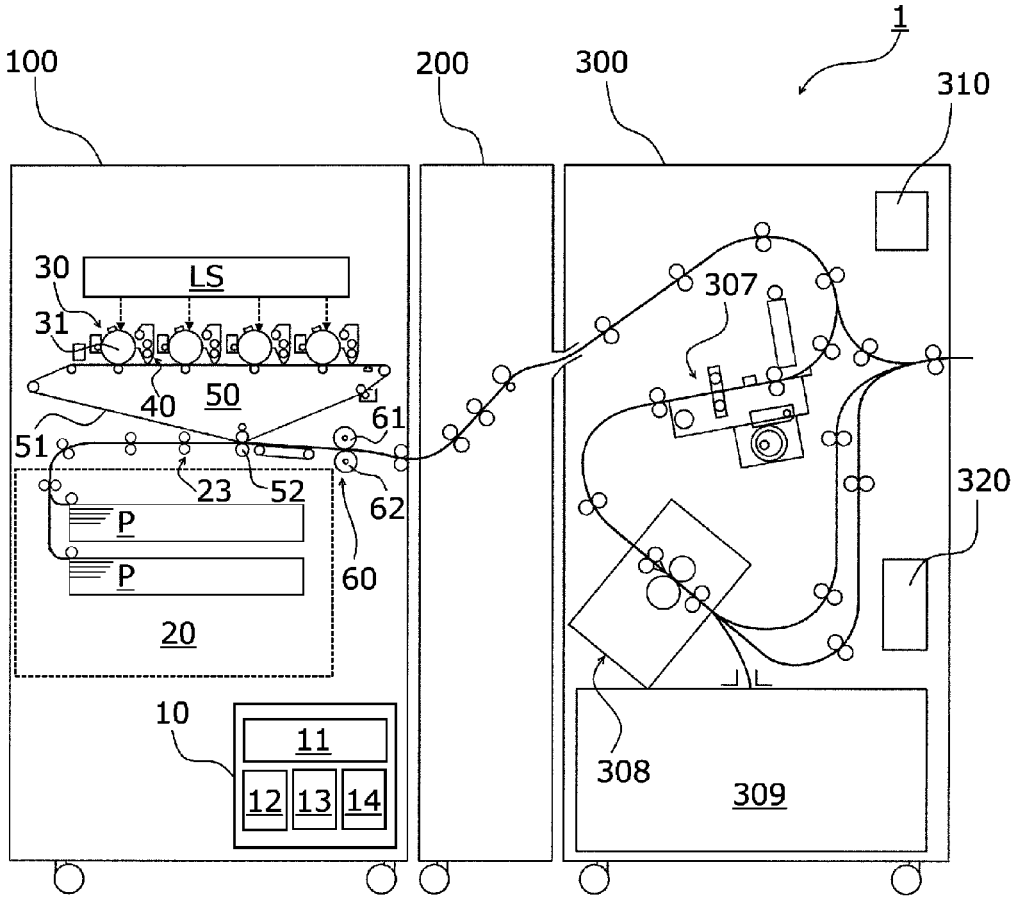
FIG. 1 is a schematic sectional view illustrating an inside configuration of an image forming system.

FIG. 1 is a schematic sectional view illustrating an inside configuration of an image forming system 1 to which this exemplary embodiment is applied. The image forming system 1 illustrated in FIG. 1 includes an image forming apparatus 100, such as a printer or a copier, that forms an image by an electrophotographic system, a transport apparatus 200 that guides a sheet P with an image recorded to a post-processing apparatus 300, and the post-processing apparatus 300 that provides post-processing on the sheet P with a toner image formed by the image forming apparatus 100.

A general configuration and an operation of the image forming system 1 are described below with reference to the drawings.

(1.1) General Configuration and Operation of Image Forming Apparatus

The image forming apparatus 100 includes a control device 10, a sheet feed device 20, photoconductor units 30, developing devices 40, a transfer device 50, a fixing device 60, and an exposure device LS.

The control device 10 includes an image forming apparatus controller 11 that controls an operation of the image forming apparatus 100, controller 12 that prepares image data in accordance with a print processing request, an exposure controller 13 that controls lighting of the exposure device LS, and a power supply device 14. The power supply device 14 supplies predetermined electric power to the photoconductor units 30, the developing devices 40, the transfer device 50, the fixing device 60, and the exposure device LS.

The sheet feed device 20 in which sheets P as recording media are stacked is provided in a bottom portion of the image forming apparatus 100. The position in the width direction of the sheets P is determined by a regulation plate (not illustrated). The sheets P are drawn one by one from the top to the front, and then the drawn sheet P is transported to a nip part of a registration roller pair 23.

The photoconductor units 30 are arranged above the sheet feed device 20 in parallel and respectively include photoconductor drums 31 that are rotationally driven. The developing devices 40 form toner images of yellow (Y), magenta (M), cyan (C), and black (K) respectively on the photoconductor drums 31.

The toner images of the respective colors formed on the photoconductor drums 31 of the photoconductor units 30 are sequentially electrostatically transferred (first transfer) on an intermediate transfer belt 51 of the transfer device 50, and thereby superimposed toner images in which the toners of the respective colors are superimposed are formed. The superimposed toner images on the intermediate transfer belt 51 are collectively transferred by a second transfer roller 52, on the sheet P sent out from the registration roller pair 23 and guided by a transport guide.

The sheet P with the toner images collectively transferred in the transfer device 50 is transported to the fixing device 60 in a state in which the toner images are not fixed. The toner images are fixed by effects of pressure and heat by a pair of a heat module 61 and a pressure module 62.

The sheet P with the fixed toner images formed is guided by a transport guide (not illustrated), and is transported through the transport apparatus 200 to the post-processing apparatus 300.

(1.2) General Configuration and Operation of Post-Processing Apparatus

The post-processing apparatus 300 includes a crease forming section 307 that forms a crease on the sheet P received from the transport apparatus 200, a side edge part removing section (top and bottom trimmer) 308 that removes side edge parts CP of the sheet P, and a sheet-waste housing section 309 that houses the removed side edge parts CP of the sheet P as waste.

Further, the post-processing apparatus 300 includes a post-processing controller 310 that includes a central processing unit (CPU) and a read-only memory (ROM) and that controls respective functional sections of the post-processing apparatus 300. The post-processing apparatus 300 also includes a user interface (UI) 320 that receives an operation input from a user and relating to the post-processing.

In the image forming system 1, a finisher device may be connected subsequently to the post-processing apparatus 300 for sheets P output from the post-processing apparatus 300. The finisher device includes, for example, a compile tray that aligns and compiles the sheets P, an end binding mechanism (stapler) that binds end portions of the sheets P, and a saddle stitching and folding processing mechanism (see FIG. 7A) that provides saddle stitching and folding processing to make a booklet.

With such a system configuration, the image forming system 1 may continuously execute, for example, a series of works (print units) for creating a booklet.

(2) Transport Apparatus

Figure 2:
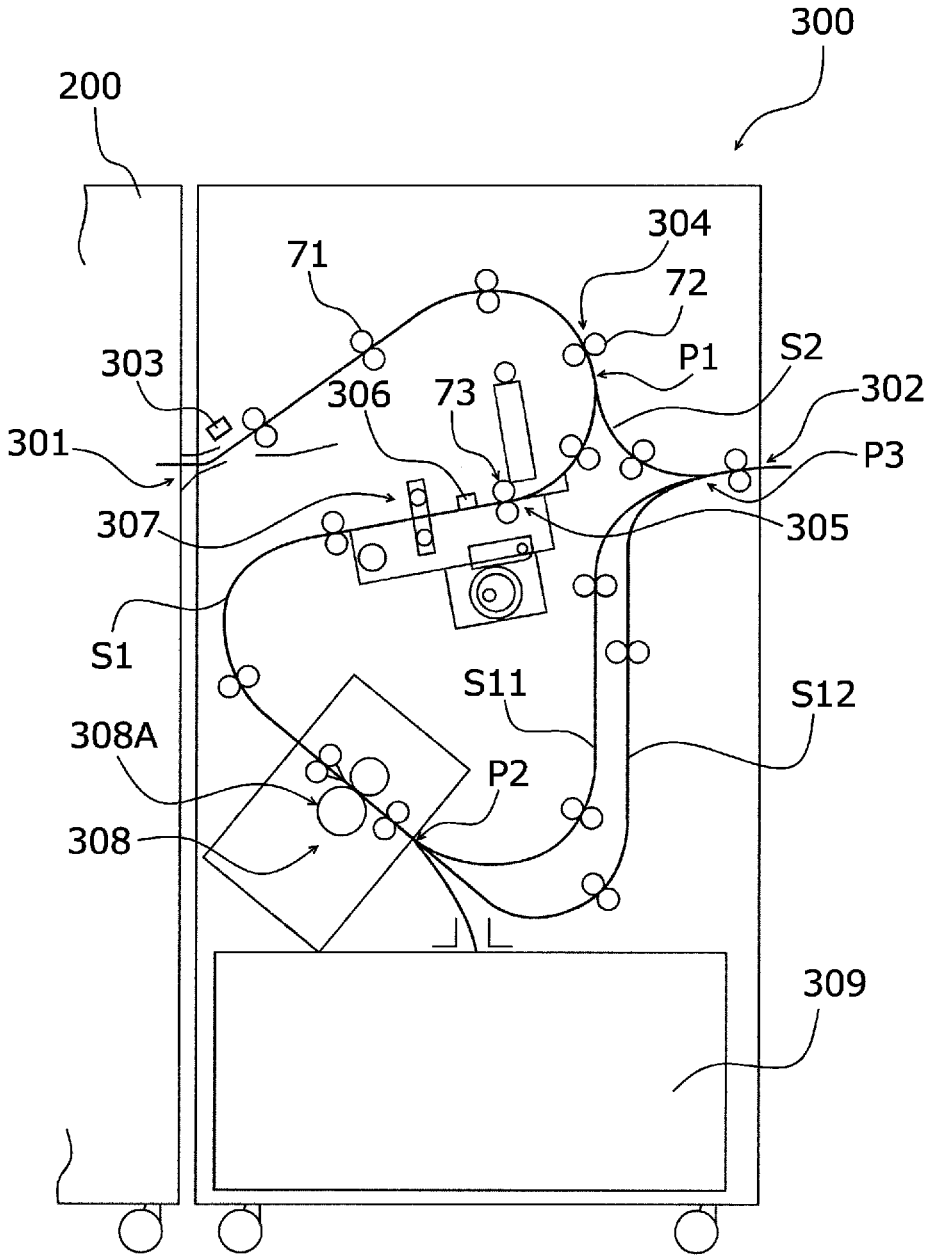
FIG. 2 is a schematic sectional view of a post-processing apparatus.
Figure 3:
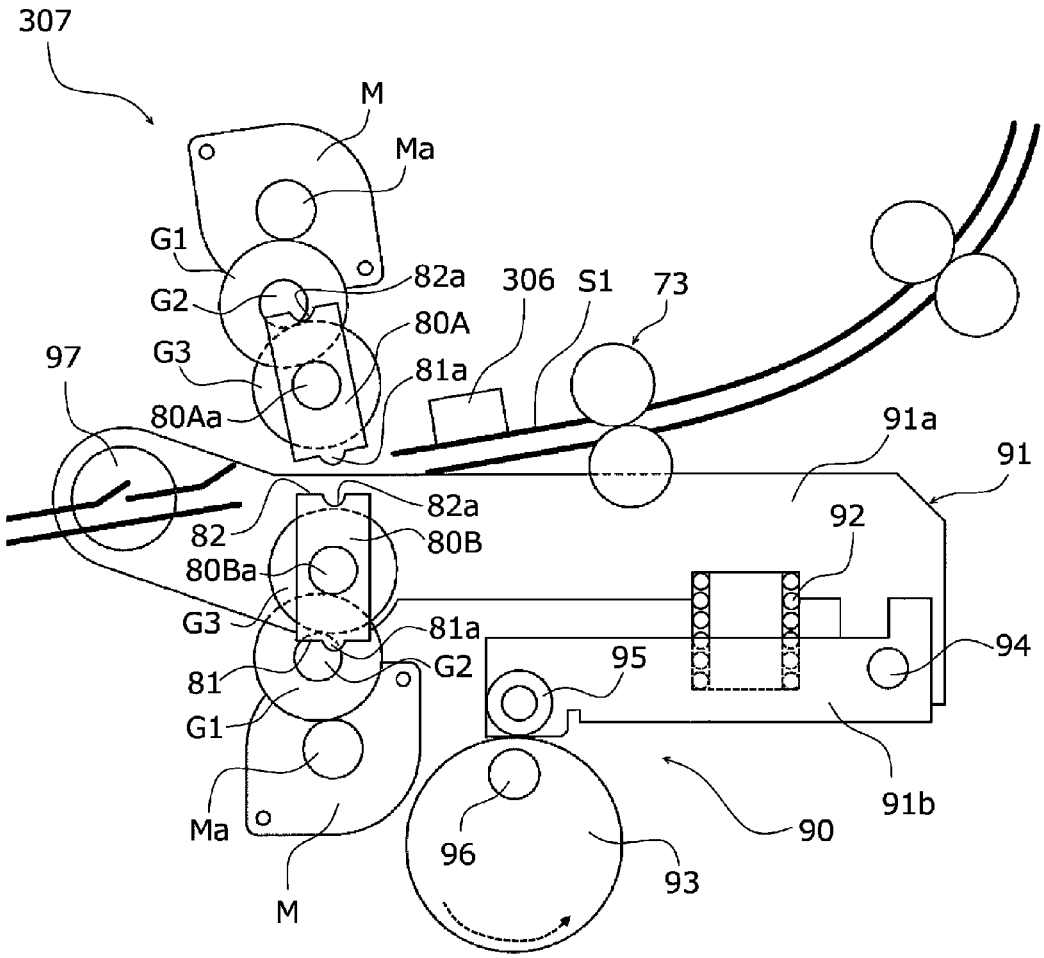
FIG. 3 illustrates an area around a crease forming section and illustrates an example of a motion when a crease is not formed.
Figure 4:
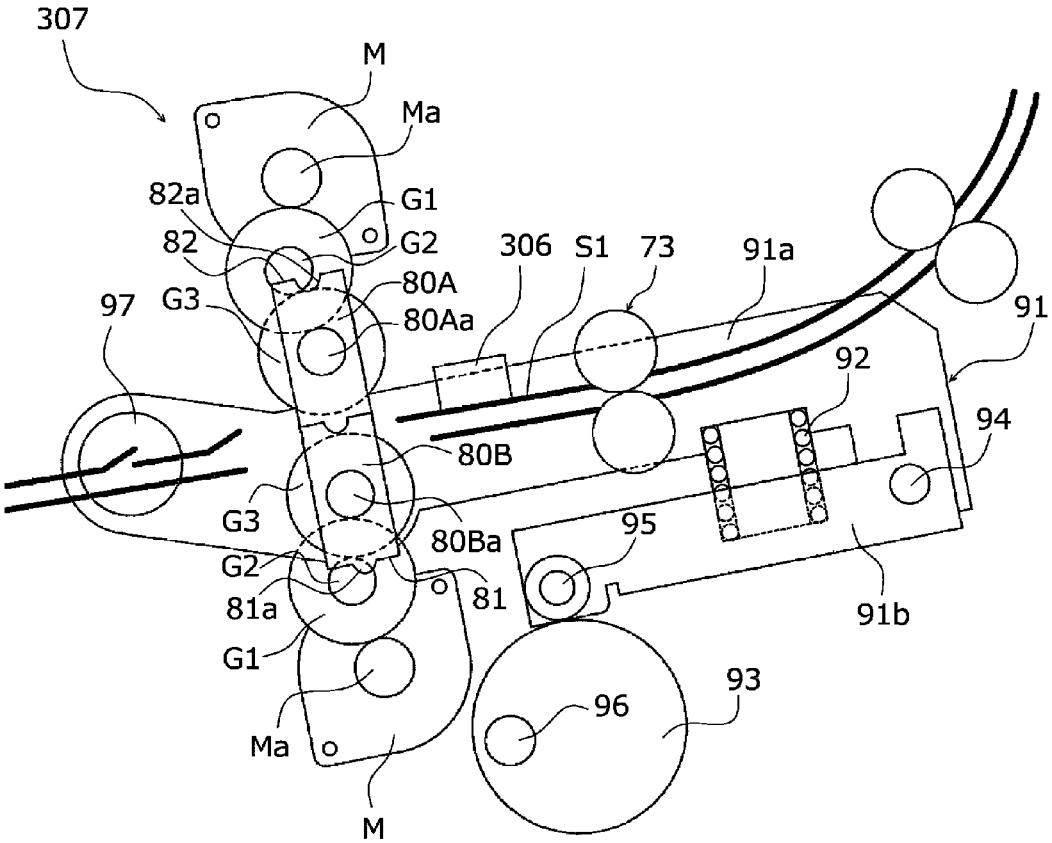
FIG. 4 illustrates an area around the crease forming section and illustrates an example of a motion when a crease is formed.
Figure 5A:
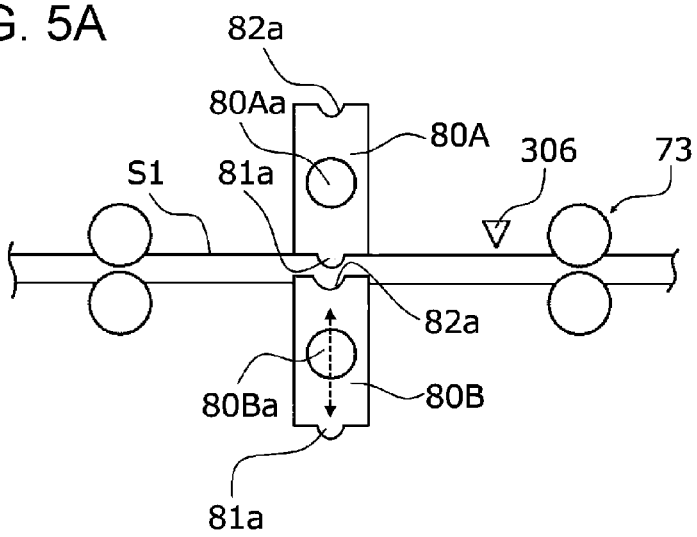
FIGS. 5A to 5C illustrate motions of an upper block and a lower block used in the crease forming section.
Figure 5B:
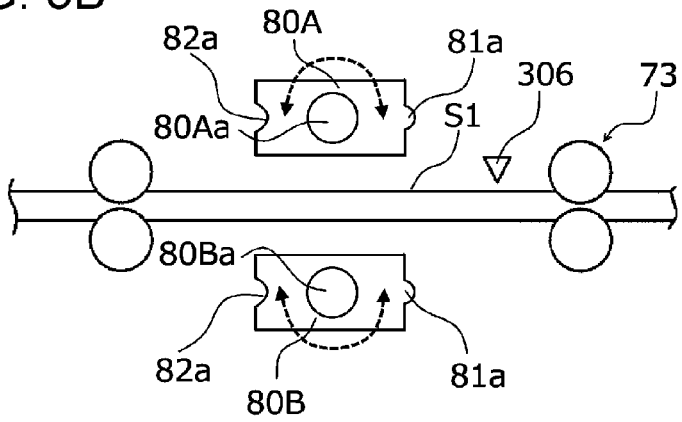
Figure 5C:
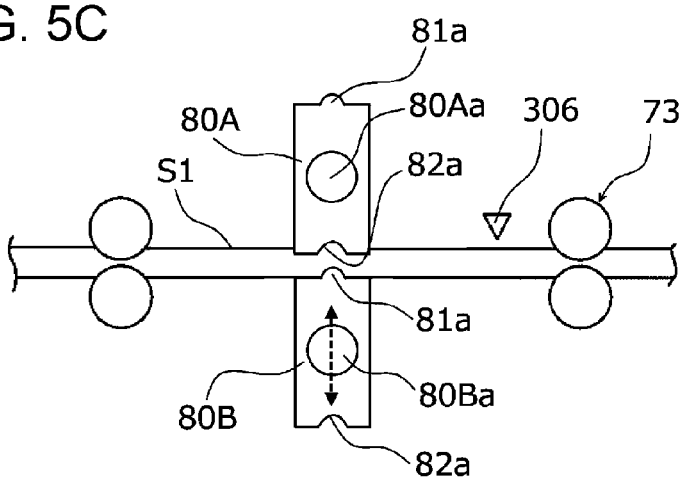

FIG. 2 is a schematic sectional view of the post-processing apparatus 300. FIG. 3 illustrates an area around the crease forming section 307 and illustrates an example of a motion when a crease is not formed. FIG. 4 illustrates an area around the crease forming section 307 and illustrates an example of a motion when a crease is formed, FIGS. 5A to 5C illustrate motions of an upper block 80A and a lower block 80B used in the crease forming section 307.

A configuration and an operation of the post-processing apparatus 300 are described below with reference to the drawings.

(2.1) General Configuration

As illustrated in FIG. 2, the post-processing apparatus 300 has a reception port 301 for receiving the sheet P transported from the image forming apparatus 100, and an output port 302 for outputting the sheet P.

Also, the post-processing apparatus 300 includes a skew detector 303 that detects skew of the received sheet P with respect to a transport direction of the sheet P, a first tilt corrector 304 having swing rollers 72 that correct skew, a second tilt corrector 305 that corrects skew by bringing the leading end of the sheet P into contact with skew correction rollers 73, a detector 306 that detects the positions of the leading end and both ends of the sheet P corrected by the second tilt corrector 305, the crease forming section 307 that forms a crease on the sheet P, the side edge part removing section (top and bottom trimmer) 308 that removes side edge parts CP of the sheet P, and the sheet-waste housing section 309 being an example of a side edge part housing section that houses the removed side edge parts CP of the sheet P as sheet waste.

(2.2) Sheet Transport Path

The post-processing apparatus 300 has a first sheet transport path S1 as a transport path of the sheet P. The first sheet transport path S1 extends from the reception port 301 as a start point to the output port 102.

Also, the first sheet transport path S1 is provided to pass through the skew detector 303, the first tilt corrector 304, the second tilt corrector 305, the detector 306, the crease forming section 307, and the side edge part removing section (top and bottom trimmer) 308.

With the first sheet transport path S1, the sheet P received at the reception port 301 is transported to the skew detector 303, the first tilt corrector 304, the second tilt corrector 305, the detector 306, the crease forming section 307, and the side edge part removing section 308.

The first sheet transport path S1 branches into a first branch path S11 and a second branch path S12 at a position located downstream of the side edge part removing section 308 (see P2 in FIG. 2). The first branch path S11 and the second branch path S12 join into one at a position located upstream of the output port 302 (see P3 in FIG. 2).

Further, the post-processing apparatus 300 has a second sheet transport path S2 branching from the first sheet transport path S1.

The second sheet transport path S2 branches from the first sheet transport path S1 at a position located downstream of the first tilt corrector 304 and upstream of the crease forming section 307 (see P1 in FIG. 2). The second sheet transport path S2 extends from a position at which the second sheet transport path S2 is connected with the first sheet transport path S1 as a start point to the output port 302.

A sheet P the crease of which is not formed by the crease forming section 307 and the side edge parts of which are not removed by the side edge part removing section 308 is transported through the second sheet transport path S2 to the output port 302.

The branch point (P1) at which the second sheet transport path S2 branches from the first sheet transport path S1, the branch point (P2) at which the first sheet transport path S1 branches into the first branch path S11 and the second branch path S12, and the joint point (see P3 in FIG. 2) at which the first branch path S11, the second branch path S12, and the second sheet transport path S2 join into one are provided with gates (not illustrated) for switching the transport path of the sheet P.

Also, plural transport rollers 71 are provided in the first sheet transport path S1 and the second sheet transport path S2. The transport rollers 71 transport the sheet P to the downstream side in the sheet transport direction.

(2.3) Function and Operation of Post-Processing Apparatus

The skew detector 303 includes two detecting members provided in a direction intersecting with (orthogonal to) the transport direction of the sheet P. Each detecting member includes a light emitting element and a light receiving element. The skew detector 303 calculates skew in the direction intersecting with (orthogonal to) the transport direction of the transported sheet P from a time difference in shielding of light when the sheet P passes through the two detecting members.

The first tilt corrector 304 includes the swing rollers 72. The swing rollers 72 include a driving roller that is rotationally driven by a motor, and a driven roller that is rotated by contacting the driving roller and receiving a driving force from the driving roller.

First ends of shafts of the swing rollers 72 are fixed, and second ends of the shafts are able to be tilted with respect to the direction intersecting with (orthogonal to) the transport direction of the sheet P. The tilt amount of the swing rollers 72 is set in accordance with the skew amount of the sheet P detected by the skew detector 303 immediately before the sheet P arrives.

If the swing rollers 72 pinch the sheet P in a tilted state, the state is restored from the tilted state to an original non-tilted state, and the sheet P is transported in a state in which the skew of the sheet P is corrected.

The second tilt corrector 305 corrects the skew of the sheet P corrected by the first tilt corrector 304, with higher accuracy. The second tilt corrector 305 includes the skew correction rollers 73 that correct the skew by bringing the sheet P into contact with the skew correction rollers 73.

The skew correction rollers 73 are kept in a state in which rotation is stopped immediately before the sheet P contacts the skew correction rollers 73. The sheet P contacts the skew correction rollers 73 and forms a loop. The rotation of the skew correction rollers 73 is resumed at a timing at which the loop is generated, and the skew of the sheet P is corrected.

The detector 306 detects the leading end and side ends of the sheet h respect to the transport direction of the sheet P. For example, the positions of the leading end and side ends of the sheet P are detected by line sensors. In this case, the positions of the side ends in the direction orthogonal to the transport direction of the sheet P vary depending on the sheet P.

The crease forming section 307 includes a pair of opposite members (see upper block 80A, lower block 80B in FIG. 3) that advance from sides of the first sheet transport path S1 toward the first sheet transport path S1. By pressing the pair of opposite members to the sheet P, a crease is formed on the sheet P. A device that provides folding processing provided subsequently to the post-processing apparatus 300 folds the sheet P along the crease.

If the crease is not formed on the sheet P, the sheet P is transported to the side edge part removing section 308 without formation of the crease.

The side edge part removing section 308 is a device that executes trimming. The side edge part removing section 308 removes portions of side edge parts CP (side edge parts along the first sheet transport path S1) of the sheet P. The side edge part removing section 308 includes, for example, the cutter unit (rotary cutter unit) 308A having a shaft provided in the direction orthogonal to the transport direction of the sheet P and a disk-shaped blade fixed to the shaft.

The cutter unit 308A includes two cutter units 308A provided in the direction intersecting with (orthogonal to) the transport direction of the sheet P, and simultaneously removes side edge parts CP at both end portions of the sheet P.

The width of the sheet P varies depending on the booklet to be made. Hence the two cutter units 308A move along the shafts in accordance with the positions of the sides of the sheet P detected by the detector 306 and the sizes of the side edge parts CP of the sheet P to be trimmed, and cut off the side edge parts CP of the sheet P.

The sheet-waste housing section 309 houses the side edge parts CP of the sheet P cut off in the side edge part removing section 308, as sheet waste.

If the sheet P not trimmed, the sheet P is transported to the output port 302 in a state in which the side edge parts CP of the sheet P are not removed.

2.4 Formation of Crease on Sheet

The crease forming section 307 includes an upper block 80A and a lower block 80B as one and the other of a pair of opposite members provided on the upper and lower sides with respect to the first sheet transport path S1, and a pressing and releasing mechanism 90 that holds the lower block 80B rotatably and movably, causes the lower block 80B to press the upper block 80A, and causes the lower block 80B to release the pressure.

The upper block 80A and the lower block 80B have columnar shapes, respectively have shafts 80Aa and 80Ba substantially at the center, and are rotatably supported.

The upper block 80A includes a first surface 81 having a round-shaped or substantially round-shaped (R-shaped) protrusion 81*a* as a protrusion. The lower block 80B includes a second surface 82 having a round-shaped or substantially round-shaped (R-shaped) groove 82*a* as a recess.

The shaft 80Aa of the upper block 80A and the shaft 80Ba of the lower block 80B are coupled to driving sources M such as motors through gear trains as driving transmission units. To be more specific, gears G1 mesh with driving shafts Ma of the driving sources M, gears G2 are coaxially fixed to the gears G1, and the gears G2 mesh with gears G3 coaxially fixed to the respective shafts 80Aa and 80Ba. Accordingly, the upper block 80A and the lower block 80B are rotatably supported, and are fixed at a first position for forming a crease protruding in a first direction on a sheet. P and a second position for forming a crease protruding in a second direction reverse to the first direction.

The pressing and releasing mechanism 90 includes an arm portion 91 that rotatably and movably supports the lower block 80B, an urging member 92 such as a pressurized spring provided at the arm portion 91, and a cam 93 that moves the arm portion 91.

The arm portion 91 includes a first arm part 91*a* that supports the lower block 80B, and a second arm part 91*b* connected to the first arm part 91*a* through a shaft 94 in a bending manner. The urging member 92 is provided between the first arm part 91*a* and the second arm part 91*b*, at a position near the shaft 94. A gear 95 is provided at a tip end of the second arm part 91*b* and meshes with the cam 93.

Since the cam 93 is rotated around a shaft 96 as an axis, the gear 95 is rotated, and the lower block 80B moves toward the upper block 80A and presses the upper block 80A or the lower block 80B is separated and releases the pressure while a support 97 serves as an axis, via the urging member 92.

When the crease forming section 307 forms a crease on a sheet P to be transported, as illustrated in 5A, the R-shaped protrusion 81*a* of the upper block 80A and the R-shaped groove 82*a* of the lower block 80B are rotated to and fixed at mutually opposite positions with respect to the first sheet transport path S1 (first position), the lower block 80B moves toward the upper block 80A, the R-shaped protrusion 81*a* engages with the R-shaped groove 82*a*. In this state, the lower block 80B presses the upper block 80A, and forms a crease protruding in the first direction on the sheet P.

As illustrated in 5C, the R-shaped groove 82*a* of the upper block 80A and the R-shaped protrusion 81*a* of the lower block 80B are rotated to and fixed at mutually opposite positions with respect to the first sheet transport path S1 (second position), the lower block 80B moves toward the upper block 80A, and the R-shaped protrusion 81*a* engages with the R-shaped groove 82*a*. In this state, the lower block 80B presses the upper block 80A, and forms a crease protruding in the second direction on the sheet P, reverse to the first direction.

That is, the upper block 80A and the lower block 80B as the pair of opposite members being columnar bodies have the recesses and protrusions as crease forming portions whose shapes are different every about 180 degrees. When the upper block 80A and the lower block 80B are rotated around the shafts 80Aa and 80Ba by about 180 degrees, creases in two different directions are formed. The creases in the different directions are selectively switched depending on the output destination of the sheet P.

If the sheet P to be transported passes through the crease forming section 307 without formation of a crease, the upper block 80A and the lower block 80B are separated as illustrated in FIG. 3. Alternatively, as illustrated in FIG. 5B, the upper block 80A and the lower block 80B may be rotated so that the R-shaped protrusion 81*a* and the R-shaped groove 82*a* of the upper block 80A and the R-shaped protrusion 81*a* and the R-shaped groove 82*a* of the lower block 803 are arranged in a direction substantially parallel to the first sheet transport path S1.

(3) Crease Forming Operation

Figure 6:
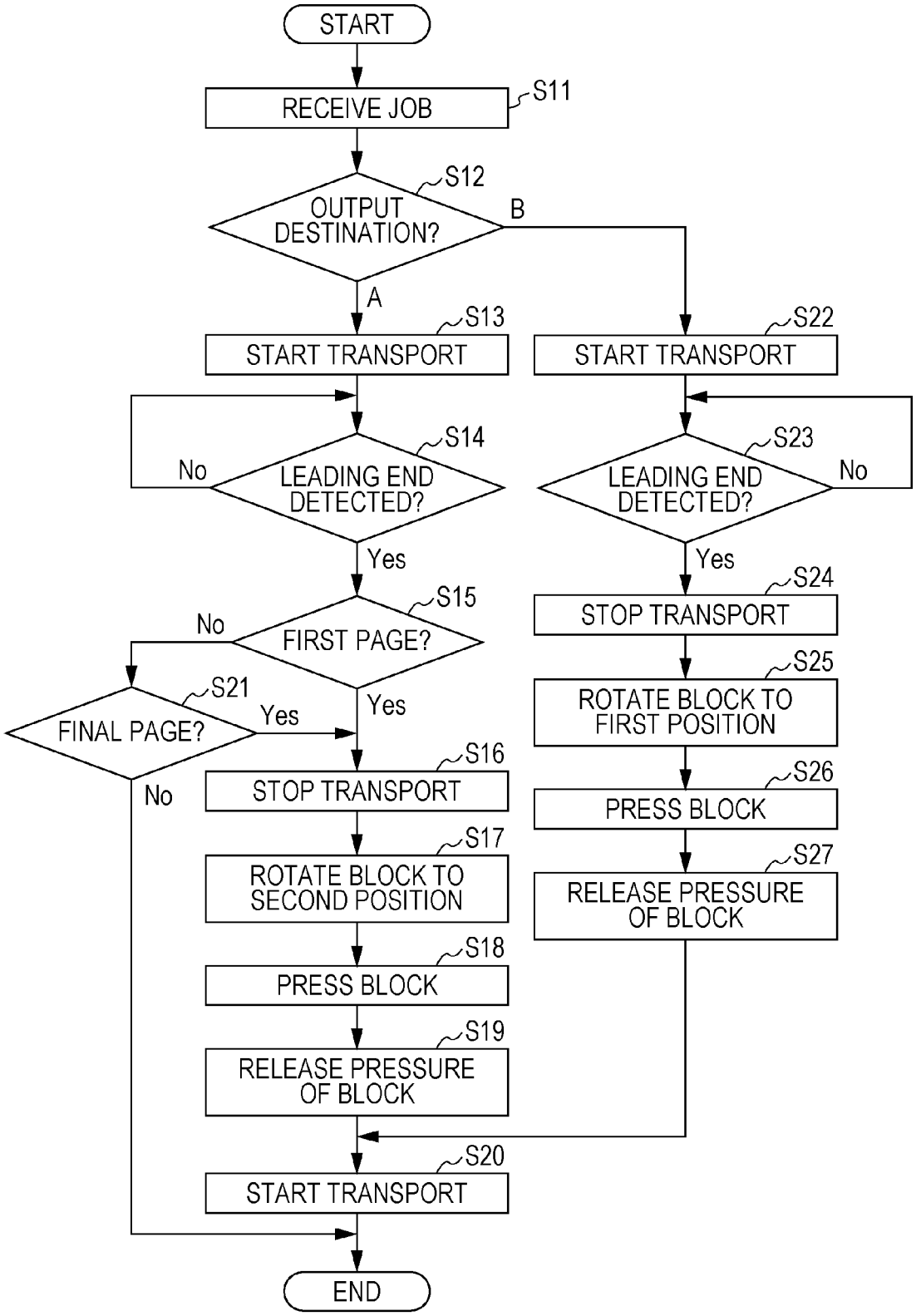
FIG. 6 is a flowchart illustrating a flow of a crease forming operation in the crease forming section.
Figure 7A:
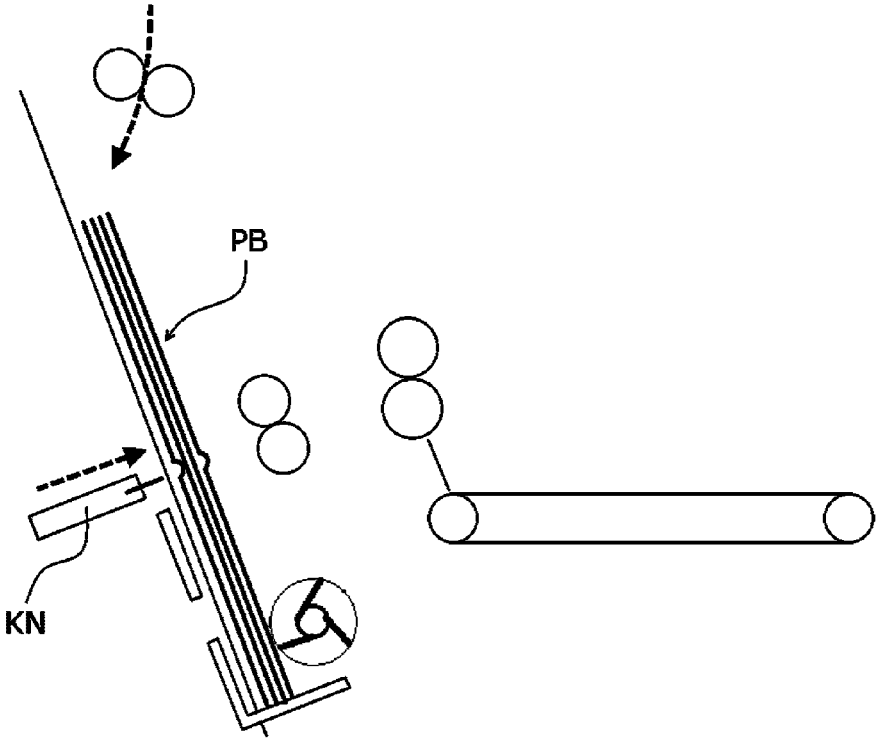
FIG. 7A is a schematic illustration for explaining saddle folding processing by a saddle stitching and folding processing mechanism.
Figure 7B:
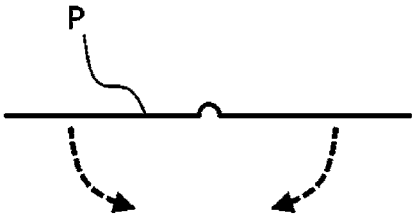
FIG. 7B is a schematic illustration illustrating mountain folding of a sheet having a crease in a second direction.
Figure 7C:
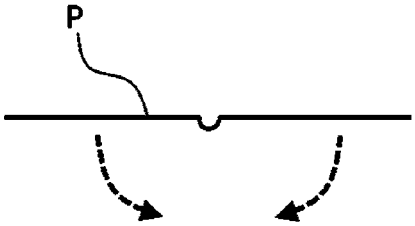
FIG. 7C is a schematic illustration illustrating valley folding of a sheet having a crease in a first direction.

FIG. 6 is a flowchart illustrating crease forming operation in the crease forming section 307, FIG. 7A is a schematic illustration for explaining saddle folding processing by a saddle stitching and folding processing mechanism, FIG. 7B is a schematic illustration illustrating mountain folding of a sheet P having a crease in the second direction, and FIG. 7C is a schematic illustration illustrating valley folding of a sheet P having a crease in the first direction.

A flow of crease forming operation by the crease forming section 307 in the post-processing apparatus 300 according to this exemplary embodiment is described below on the basis of the flowchart.

The posit ion of the crease forming section 307 is switched between a first position and a second position depending on the output destination of a sheet P. At the first position, the first surface 81 having the R-shaped protrusion 81*a* of the upper block 80A engages with the second surface 82 having the R-shaped groove 82*a* of the lower block 80B and hence a crease protruding in the first direction is formed. At the second position, the second surface 82 having the R-shaped groove 82*a* of the upper block 80A engages with the first surface 81 having the R-shaped protrusion 81*a* of the lower block 80B and hence a crease protruding in the second direction is formed.

When the post-processing controller 310 receives a job (S11), the post-processing controller 310 determines the output destination of the sheet P with crease forming processing executed (S12). To be more specific, it is determined whether the sheet P is output to a saddle stitching and folding processor (see FIG. 7A) that executes saddle stitching and folding processing and making a booklet (S12; A), or the sheet P is output to a folding device that executes folding processing on the sheet P with the crease forming processing executed or to an output tray to be manually folded (S12; B).

In step S12, if the output destination is determined as the saddle stitching and folding processor (S12; A), transport of the sheet P is started (S13). When the detector 306 detects the leading end of the sheet P (S14; Yes), it is determined whether or not the sheet P is the first page (S15).

If the sheet P is the first page (S15; Yes), the transport of the sheet P is stopped at a predetermined position in the first sheet transport path S1 between the upper block 80A and the lower block 80B (S16). Then, the upper block 80A and the lower block 80B are rotated, and are fixed at a designated second position (S17).

Then, the lower block 80B moves in a direction to press the upper block 80A by the action of the pressing and releasing mechanism 90, and a crease protruding in the second direction is formed on the sheet P (S18). The lower block 80B moves in a direction to release the pressure from the upper block 80A by the action of the pressing and releasing mechanism 90 (S19), and transport of the sheet P toward the saddle stitching and folding processor is started (S20).

If it is determined in step S15 that the sheet P is not the first page (S15; No), it is further determined whether or not the sheet P is the final page (S21). If the paper is the final page (S21; Yes), the operation in step S16 and later is executed to form a crease protruding in the second direction on the sheet P. If the sheet P is not the final page (S21; No), the crease is not formed on the sheet P and the sheet P is transported.

Accordingly, if the output destination is the saddle stitching and folding processor, as schematically illustrated in FIGS. 7A and 7B, creases are formed only on the inner and outer sheets of a sheet bundle PB, on which the saddle stitching and folding processing is executed and which becomes a booklet, and the sheet bundle PB is mountain-folded in the same direction as the protruding direction of the creases with a folding knife KN.

Consequently, for saddle stitching, by forming creases only on the inner sheet being the first page and the outer sheet being the final page of the sheet bundle, productivity of the post-processing apparatus 300 may be increased.

In step S12, if the output destination is determined as the folding device that executes folding processing on the sheet P with the crease forming processing executed, or the output tray (S12; B), transport of the sheet P is started (S22). When the detector 306 detects the leading end of the sheet P (S23; Yes), the transport of the sheet P is stopped at a predetermined position in the first sheet transport path S1 between the upper block 80A and the lower block 80B (S24).

Then, the upper block 80A and the lower block 80B are rotated, and are fixed at a designated first position (S25).

Then, the lower block 80B moves in a direction to press the upper block 80A by the action of the pressing and releasing mechanism 90, and a crease protruding in the first direction is formed on the sheet P (S26). The lower block 80B moves in a direction to release the pressure from the upper block 80A (S27), and transport of the sheet P toward the folding device or the output tray is started (S20).

The sheet P with the crease protruding in the first direction formed by the crease forming section 307 is valley-folded in a direction opposite to the direction of the crease manually or by the folding device (see FIG. 7C).

As described above, with the post-processing apparatus 300 according to this exemplary embodiment, since the position at which a crease is formed is switched between the first position at which a crease protruding in the first direction is formed on a sheet P and a second position at which a crease protruding in the second direction reverse to the first direction is formed on the sheet P, depending on the output destination of the sheet P. Accordingly, the crease forming function may be commonly used for folding processing with a folding device, and a line forming function for manual folding and for saddle stitching.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing device, comprising:

a pair of first and second opposite members extending in a predetermined direction of a recording medium, each of the opposite members including a first surface having a protrusion and a second surface having a recess, the opposite members facing each other to interpose the recording medium therebetween and being rotatable, wherein a position of the opposite members is switched between a first position, at which the first surface of the first opposite member and the second surface of the second opposite member engage with each other and form a crease protruding in a first direction on the recording medium, and a second position, at which the second surface of the first opposite member and the first surface of the second opposite member engage with each other and form a crease protruding in a second direction reverse to the first direction on the recording medium, depending on an output destination of the recording medium.

2. The post-processing apparatus according to claim 1, wherein the recording medium includes a plurality of pages by a predetermined number, and a page of the recording medium on which a crease is formed is selected from the plurality of pages depending on the output destination of the recording medium.

3. The post-processing apparatus according to claim 1, wherein the recording medium includes a plurality of pages having a group of images, and the output destination includes a saddle stitching and folding processor that forms a saddle-stitched booklet by folding the recording medium.

4. The post-processing apparatus according to claim 1, wherein the protrusion and the recess have substantially round shapes in a sectional view in a direction intersecting with a transport direction of the recording medium.

5. An image forming system, comprising an image forming apparatus that forms an image on a sheet; and the post-processing apparatus according to claim 1.

* * * * *